United States Patent [19]

Komninos et al.

[11] 4,155,710

[45] May 22, 1979

[54] PROCESS FOR PREVENTING FADING IN TEXTILES

[75] Inventors: John A. Komninos, Upper Saddle River, N.J.; Elliot H. Baum, Spring Valley, N.Y.

[73] Assignee: Kewanee Industries, Inc., Bryn Mawr, Pa.

[21] Appl. No.: 891,621

[22] Filed: Mar. 30, 1978

[51] Int. Cl.[2] ..... D06M 13/46; D06P 5/02

[52] U.S. Cl. ..... 8/74; 8/165; 8/37; 260/401

[58] Field of Search ..... 8/74, 165, 37

[56] References Cited

U.S. PATENT DOCUMENTS

| | | | |
|---|---|---|---|
| 2,583,772 | 1/1952 | Gunderson | 260/401 |
| 3,074,815 | 1/1963 | Lee et al. | 8/188 |
| 3,353,901 | 11/1967 | Taube et al. | 8/74 |
| 3,492,324 | 1/1970 | Blackman | 260/401 |
| 3,933,871 | 1/1976 | Amerstrong | 258/8.75 |

FOREIGN PATENT DOCUMENTS

| | | | |
|---|---|---|---|
| 43-243 | 1/1968 | Japan | 8/74 |
| 816617 | 7/1959 | United Kingdom | 260/404.5 |

*Primary Examiner*—Melvyn I. Marquis
*Assistant Examiner*—Maria S. Tungol
*Attorney, Agent, or Firm*—Arthur A. Jacobs

[57] ABSTRACT

The prevention of fading of denim fabric by treating the fabric with a compound or mixture of compounds having the formula wherein R is a linear unbranched saturated or unsaturated chain having from 7 to 17 carbon atoms, R′ is either ethyl or methyl, $X^-$ is an anion selected from the group consisting of chloride, bromide methosulfate and ethosulfate, and n is an integer of from 1 to 6, and wherein at least 75 percent of the weight of the composition comprises a compound or mixture of compounds in which n is an integer of between 1 and 4.

4 Claims, No Drawings

PROCESS FOR PREVENTING FADING IN TEXTILES

This invention relates to a method for preventing ozone-fading of indigo-dyed denim. As used herein, the term "denim" refers to 100% cotton fabrics, or blends of cotton and wool, or blends of cotton and synthetic fibers in which the fiber content of the blend is at least 40% cotton. The term "indigo" refers to a class of insoluble blue dyes which contain in their chemical structure the chromophore

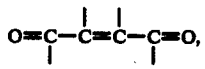

this structure being contained in groups such as

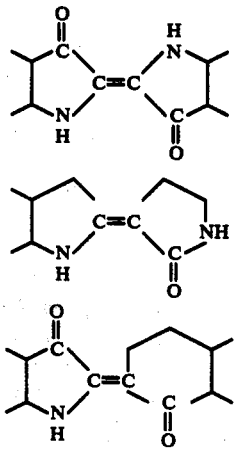

and similar groups in which the imino group is replaced by atoms such as sulfur, selenium or oxygen.

When insoluble indigoid dyes are used for dying cotton, wool, synthetic fabrics or mixtures of such fibers, the dye is first reduced to lueco form which renders it water soluble. In this state, it is padded onto a fibrous textile by methods well known in the art. Upon subsequent oxidation by air or other oxidizing media, the insoluble form of the dye is re-established and the dye becomes "fixed" on the fiber with good fastness properties.

The blue indigoid dyes, especially the blue indigo itself, of formula

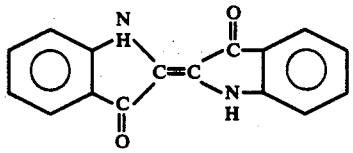

have always been valued as dyeing agents in the dyeing of work clothes and industrial clothes and, more recently, in the dyeing of leisure clothes made of cotton blends. They have also been used in the dyeing of wool in heavy shades, such as in navy uniforms.

Although the importance of indigoid dyes once declined due to the advent of faster anthraquinone and sulfur dyes, their use has, more recently, been reactivated due, principally, to the present popularity of blue denim clothes for all purposes. However, as is well known to those skilled in the art of dyeing denim, there is a very serious problem associated with indigo-dyed denim, especially in the light blue shades. This shortcoming originates in that property of the dyes which makes them fade upon exposure to the atmosphere. Whatever the cause of such fading, be it due to ozone, light, oxygen, oxides of nitrogen, oxides of sulfur, or anything else, it is called "ozone fading" in the trade.

If "ozone fading" were to occur evenly over a bolt of denim cloth, or in denim clothes, then the fading problem might not be so acute. As a matter of fact, many consumers consider a "faded look" as desirable, provided the faded look is achieved in a manner consistent with their individual tastes; and it is usually done by using an excess of bleach laundering. However, before the clothes reach the consumer, the consumer generally prefers the garments to be evenly dyed. It is also generally true that the fabricators of clothes made from blue denim cloth desire evenly dyed cloth. Nevertheless, it is often the case that the fabric does not reach the converter evenly dyed nor do the clothes reach the consumer evenly dyed.

It is well known in the trade that during storage or shipping of bolts of cloth or garments, those areas which are in close contact with each other while stacked up or folded do not undergo appreciable fading, but that noticeable fading does occur on the outside of the folds, or at those ends of the material which are directly exposed to the atmosphere. This is true not only for the bolts of fabric but for stacked up garments as well. With the passage of time, during storage or shipping, such exposed folds or ends fade much more than the closely packed areas, and acquire a much lighter color than the unexposed areas. In fact, the fading at the outer folds or ends occurs to such an extent that it is clearly visible, and it is possible to see the faded stripes, or faded ends of the material which had been exposed to the atmosphere. This partial fading causes the unconverted cloth, or the finished garments, to be considered as inferior articles of commerce, and, therefore, of drastically reduced commercial value.

In an effort to protect the blue denim from uneven ozone fading, or, at least, to reduce the rate at which ozone fading occurs, many dyers have added reducing dextrins and starches concurrently with the dye. Starch and dextrin films, when these substances are used as sizing, may afford some temporary protection, but when the sizing is washed off or cracks, ozone fading may ensue.

The addition of polymers, resins, pre-polymers, and starch-like materials to the blue denim, and then drying them, or polymerizing the additives, in order to prevent fading, has also been attempted.

However, all the treatments mentioned above usually fail to protect the blue denim adequately. Very often they impart a hard, harsh finish to the cloth, and sometimes they cause such large shade changes that it is impossible to compensate for them by any subsequent treatment. In this condition, the blue, or offblue, cloth is generally considered to be of inferior quality and, therefore, of reduced commercial value.

In accordance with the present invention, it has now been discovered that there is a simple, relatively inexpensive method of preventing ozone fading of indigo blue dyed denim, whether in unconverted fabric or in garments. This method of preventing ozone fading is effective during the normal course of the life of blue denim from the dyeing of the fabric to the retail sale of the fabrics or of the fabric or of garments made therefrom.

More specifically, it has been discovered that ozone-fading of indigo blue dyed cloth can be prevented for a substantial period of time by treating the dyed cloth with a compound, or mixture of compounds, of the formula:

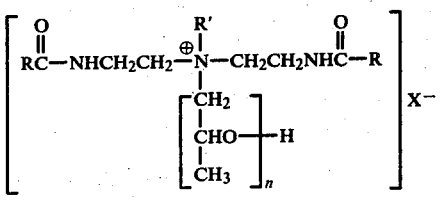

where R represents a linear unbranched saturated or unsaturated chain of from 7 to 17 carbon atoms such as is found in fatty acids; R′ represents either a methyl or ethyl group; X− represents an anion selected from the group consisting of chloride, bromide, methosulfate and ethosulfate; and n represents an integer of from 1 to 6 such that at least 75% of the weight of the mixture is composed of compounds in which n is from 1 to 4.

The method of making these compounds is well known and is disclosed in U.S. Pat. No. 3,933,871, as well as in British Pat. No. 816,617 and in U.S. Pat. No. 3,074,815. Methods of making similar compounds are disclosed in British Pat. No. 833,748, U.S. Pat. No. 2,474,202, U.S. Pat. No. 2,854,323 and U.S. Pat. No. 3,225,074.

Cloth that has been dyed indigo blue, and then treated with a compound, or a mixture of compounds, having the formula shown above, will not fade at the external folds of the cloth upon exposure to the atmosphere during periods of normal storage, nor will they fade in transit during shipping.

Cloth, dyed and protected in the manner of the present invention, after being converted into garments, will retain the original color at the folds or at the ends when the garments are stacked or piled up for purposes of normal storage, shipping or retail display.

The method of applying the compounds of this invention to denim cloth is simple and requires no additional equipment outside the normal equipment used for either batch-process or continuous-process dyeing. By using one of the dyeing machines common to the trade, the fabric is soaked in an aqueous bath containing the compound or compounds of this invention, either in solution or in dispersion. The compound or compounds are present in a concentration sufficient to allow for a quantity equal to about 1½% to about 4% of the weight of fabric being treated. In the parlance of the trade, the concentration of the compound or compounds is from 1½% to 4% based on the weight of goods being treated.

After the compound or the mixture of compounds is exhausted from the solution or dispersion because of adsorbtion or absorbtion by the fabric, the excess water is usually squeezed out of the fabric, and the fabric is dried by any means common to the trade. The resulting fabric is now protected from ozone fading, and this protection is retained until the protecting substance is either washed off or abraded off the fabric.

The products of this invention also protect indigoid dyes from ozone fading when such dyes are used in conjunction with other reduceable dyes which are not in the indigo family. For example, sulfur dyes such as sulfur black, sulfur blue, sulfur yellow, etc. are often used as "bottoms"; when used in this manner the sulfur dyes are first exhausted from the dye bath into the fabric, followed by "topping" with indigoid dyes. The "bottoms" serve many purposes. For example, they serve to enhance or alter the hue of the indigoid "tops", and they also serve to reduce the cost of dyeing with the more expensive indigo.

The products of this invention may be applied at any stage of the commercial process, from the weaving of the goods, to the fabrication of the finished garment. They may be applied during and/or after weaving, indigo dyeing, washing, bleaching, sizing, sanforizing, brushing, etc. They may even be applied before indigo dyeing and still protect the goods from ozone fading, provided subsequent processing does not remove the protective compounds.

Furthermore, if any subsequent treatment of the goods, such as desizing, washing or mechanical or chemical softening, is a treatment that removes the protective compounds, the protective compounds may be re-applied to the fabric and ozone-fading protection will be restored.

As indicated above, processors have a wide variety of options open to them as to when to apply the compounds of this invention. In addition, should washing, bleaching or distressing the garment remove the protective compounds, these compounds may be re-applied to the garment by any of the usual means known in the trade, thereby restoring protection against ozone fading.

The invention claimed is:

1. A method of treating indigo-dyed fabric to prevent fading which comprises applying to the fabric an aqueous composition comprising water and a compound or mixture of compounds having the formula:

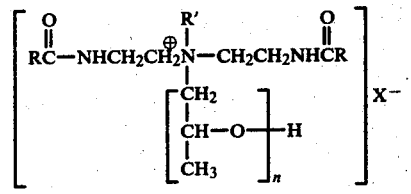

wherein R is a linear unbranched saturated or unsaturated chain having from 7 to 17 carbon atoms, R′ is either ethyl or methyl, X− is an anion selected from the group consisting of chloride, bromide, methosulfate and ethosulfate, and n is an integer of from 1 to 6, and wherein at least 75 percent of the weight of the composition comprises a compound or mixture of compounds in which n is an integer of between 1 and 4.

2. The method of claim 1 wherein the compound or mixture of compounds is in a concentration of about 1½ to 4% by weight of the fabric.

3. The method of claim 1 wherein the fabric is immersed in an aqueous bath containing the compound or mixture of compounds.

4. The method of claim 1 wherein the compound has the formula:

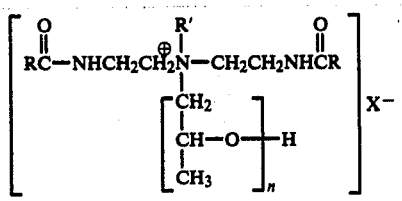
in which R represents the linear unbranched saturated and unsaturated chains found in the fatty acids of tallow; R′ is methyl; $X^-$ is methosulfate; and n represents an integer of from 1 to 6 such that at least 75% of the weight of the mixture is composed of compounds in which n is from 1 to 4.
* * * * *